US007789918B2

(12) United States Patent
Tuli et al.

(10) Patent No.: US 7,789,918 B2
(45) Date of Patent: Sep. 7, 2010

(54) LUBRICITY IMPROVING ADDITIVE COMPOSITION FOR LOW SULFUR DIESEL FUEL

(75) Inventors: Deepak Kumar Tuli, Mumbai (IN); Ajay Kumar Arora, Mumbai (IN); Shanti Prakash, Mumbai (IN); Rajiv Ranjan, Mumbai (IN); Krishan Kumar Swami, Mumbai (IN); Ajay Kumar, Mumbai (IN); Rakesh Sarin, Mumai (IN); Ram Prakash Verma, Mumbai (IN); Niranjan Raghunath Raje, Mumbai (IN)

(73) Assignee: Indian Oil Corporation Limited, Mumbai, Maharashtra (IN)

( * ) Notice: Subject to any disclaimer, the term of this patent is extended or adjusted under 35 U.S.C. 154(b) by 567 days.

(21) Appl. No.: 11/547,458

(22) PCT Filed: Aug. 9, 2004

(86) PCT No.: PCT/IN2004/000236

§ 371 (c)(1),
(2), (4) Date: Jul. 17, 2007

(87) PCT Pub. No.: WO2006/016374

PCT Pub. Date: Feb. 16, 2006

(65) Prior Publication Data

US 2008/0098642 A1 May 1, 2008

(51) Int. Cl.
*C10L 1/18* (2006.01)
*C10L 1/32* (2006.01)
*C10M 169/04* (2006.01)

(52) U.S. Cl. ..... 44/308; 44/301; 44/385; 44/388; 508/220

(58) Field of Classification Search ..... 44/308, 44/385, 388, 301; 508/220
See application file for complete search history.

(56) References Cited

U.S. PATENT DOCUMENTS

| | | | | |
|---|---|---|---|---|
| 2,143,880 | A | 1/1939 | Hughes | |
| 2,181,119 | A | 11/1939 | Caplan | |
| 2,310,146 | A * | 2/1943 | Caplan | 560/64 |
| 3,046,226 | A * | 7/1962 | Roth et al. | 508/469 |
| 5,417,725 | A | 5/1995 | Graves | |
| 6,548,459 | B2 | 4/2003 | Mondal et al. | |
| 7,427,303 | B2 * | 9/2008 | Sarin et al. | 44/301 |
| 7,473,283 | B2 * | 1/2009 | Tuli et al. | 44/307 |

* cited by examiner

*Primary Examiner*—Glenn A Caldarola
*Assistant Examiner*—Vishal Vasisth
(74) *Attorney, Agent, or Firm*—Marjama Muldoon Blasiak & Sullivan LLP

(57) ABSTRACT

The present invention relates to a additive composition for use as lubricity improver for low sulphur diesel, comprising c) 0.1-10% by weight of ester derivative derived from cashew nut shell liquid (CNSL esters) of formula (I); f) 0.1-10% by weight of ester derivative derived from cashew nut shell liquid of formula (II); g) 50-95% by weight of free fatty acid of the formula RCOOH in which R represents an alkyl/alkenyl group with 12 to 24 carbon atoms. h) 1-30% by weight of synthetic esters derived by esterifying tri, tetra, penta hydric alcohols with carboxylic acids such as lauric, palmitic, linoleic, ricinoleic etc.

(I)

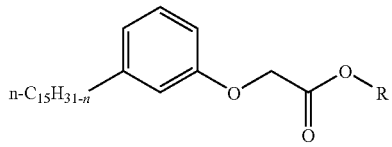

14 Claims, No Drawings

LUBRICITY IMPROVING ADDITIVE COMPOSITION FOR LOW SULFUR DIESEL FUEL

CROSS-REFERENCE TO RELATED APPLICATIONS

"This application is a 371 application of PCT/IN04/00236, filed Aug. 9, 2004." This application claims priority to and the benefit of International Application Number PCT/IN2004/000236, filed Aug. 9, 2004, and published as WO 2006/016374 A1 on Feb. 16, 2006, which application is incorporated herein by reference in its entirety.

FIELD OF THE INVENTION

The invention relates to lubricity improver composition, incorporating esters of cashew nut shell liquid (CNSL), for improvement of lubricity of low sulfur diesel.

BACKGROUND OF THE INVENTION

Cashew nut shell liquid (CNSL) occurs as a reddish brown viscous liquid in the soft honeycomb structure of the shell of cashewnut, a plantation product obtained from the cashew nut tree, Anacardium Occidentale L. Native to Brazil the tree grows in the coastal area of Asia and Africa. Cashewnut attached to cashew apple is grey colored, kidney shaped and 2.5-4 cm long. The shell is about 0.3 cm thick, having a soft leathery outer skin and a thin hard inner skin. Between these skins is the honeycomb structure containing the phenolic material popularly called CNSL. Inside the shell is kernel wrapped in a thin brown skin known as the testa.

The nut thus consists of the kernel (20-25%) the shell liquid (20-25%) and the testa (2%) and the rest being the shell. CNSL extracted with low boiling petroleum ether, contain about 90% an anacardic acid and about 10% cardol. CNSL on distillation gives a pale yellow phenolic derivatives, which are a mixture of biodegradable saturated and unsaturated m-alkyl phenols, including cardanol. Catalytic hydrogenation of these phenols gives a waxy material pre dominantly rich in tetrahydroanacardol.

CNSL and its derivatives have been known for producing high temperature phenolic resins and friction elements, as exemplified in U.S. Pat. Nos. 4,395,498 and 5,218,038. Friction lining production from CNSL is also reported in U.S. Pat. No. 5,433,774. Like wise, it is also known to form different types of friction materials, mainly for use in brake lining system of automobiles and coating resins from CNSL.

However, the first application of CNSL in malting lubricating oil additives was disclosed by us in U.S. Pat. Nos. 5,916,850 and 5,910,468.

There is a continuing need to produce fuels that meet the ever-stricter requirements of the regulatory agencies around the world. Of particular need are fuels that have low levels of aromatics and sulfur. While regulated fuel properties are not identical for all regions, there are generally achieved by the use of hydroprocessing (hydrotreating) to lower levels of both aromatics and sulfur. Hydrotreating, particularly hydrodesulfurisation, is one of the fundamental process for refining and chemical industries. The removal of feed sulfur by conversion to hydrogen sulfide is typically achieved by reaction with hydrogen over non-noble metal sulfides, especially those of Co/Mo, Ni/Mo and Ni/W, at fairly rigorous temperatures and pressures to meet product quality specifications. Environmental considerations and mandates have driven product quality specifications in the direction of low sulfur and aromatics levels.

During hydrotreating, aromatics are saturated and feed sulfur is converted to hydrogen sulfide. While this achieves the desired result with respect to emissions, it has an adverse effect on the inherent lubricity properties of the distillate fuel. Equipment can be designed for low fuel lubricity but sufficient lubricity is required for existing equipment. This lower lubricity leads to increased maintenance cost of diesel engines e.g. pump failures, and in extreme cases to catastrophic failure of the engine.

A number of types of additives have already been proposed in order to solve this problem. Antiwear additives have thus been added to diesel fuels, some of these being known in the field of lubricant, of the type of fatty acid esters and of unsaturated fatty acid dimers, aliphatic amines, esters of fatty acids and of diethanolamine and long chain aliphatic monocarboxylic acids as described in U.S. Pat. Nos. 2,252,889, 4,185,594, 4,204,481, 4,208,190 and 4,428,182. Most of these additives exhibit a sufficient lubricating power, but in concentrations, which are much too, high, and this is economically highly disadvantageous for purchase. Moreover, additives containing acid dimers, like those containing acid trimers cannot be employed in fuels fed to vehicles in which fuel may come in contact with the lubricating oil because these acid forms, by chemical reaction, deposits, which are sometimes insoluble in the oil but, above all, incompatible with detergents are usually employed.

U.S. Pat. No. 4,609,376 recommends the use of antiwear additives obtained from esters of mono- and poly-carboxylic acids and polyhydroxylated alcohols in fuels containing alcohols in their composition. U.S. Pat. No. 2,686,713 recommends the introduction of tall oil up to 60 ppm in diesel fuels in order to prevent rust formation on metal surfaces in contact with these fuels.

Another chosen route is to introduce vegetable oil esters or vegetable oil themselves into these fuels to improve their lubricating power or their lubricity. These include esters derived from rapeseed, linseed, soya and sunflower oils themselves (EP 635,558, EP 605,857). One of the major disadvantages of these esters is their low lubricating power at a concentration lower than 0.5% by weight in the fuels.

To improve the lubricating power of diesel fuels, the WO 95/33805 recommends the introduction of cold resistance additives consisting of nitrogenous additives containing one or more $>N—R^{13}$ groups in which $R^{13}$ contains 12 to 24 carbon atoms, is linear, slightly branched or alicyclic and aromatic, it being possible for the nitrogenous group to be linked via CO or $CO_2$ and form amine carboxylates or amides.

A suitable diesel fuel lubricity standard has been established by using the HFRR method (ISO 12156-1 standard): the HFRR wear scar diameters (WSD) obtained after testing a diesel fuel must be lower than 460 μm to ensure that this fuel has sufficient lubricity. When necessary, better lubricity can be restored easily by adding additives. However, these additives must have good physical and chemical stability alone or after incorporation in multifunctional formulation. They must also be fully compatible with other additives that may be present in the fuel such as flow improvers, wax antisettling additives, detergents etc.

To verify this physical and chemical compatibility and to ensure that each additive maintain its full efficiency after being mixed with others in multifunctional formulations or in fuel itself, no harm tests are carried out.

Publication JP-A-110001692 describes use of a specific mixture of $C_8$-$C_{30}$ fatty acid ester to improve the lubricity of low sulfur (0.2 wt %) middle distillate fuel oils, having an aromatic content of ≦40 wt %, suitable for use as diesel fuel. WO 99/00467 describes a fuel composition of improved lubricity comprising of lubricity additive which is an alkanolamide of an aryl-substituted fatty acid, the composition further necessarily comprises a haze inhibiting amount of dehazer.

The publication WO 01/88064 A2 describes a fuel composition, which exhibit improved antistatic properties comprising of liquid fuel which contains less than 500 ppm by weight sulfur, 0.001 to 1 ppm of hydrocarbyl monoamine or hydrocarbyl substituted poly (alkyleneamine) and 10 to 500 ppm of at least one fatty acid containing 8 to 24 carbon atoms or an ester thereof. Ikura et al in US Pat No. 2002/0178650 A1 describes a low temperature stable diesel fuel composition and a solubilizer of $C_{14-18}$ fatty acid from biodegradable sources eg. tall oil or depitched tall oil.

A PCT WO 01/44415 patent describes use of heterocyclic group containing polycyclic aromatic compounds substituted on at least one of its carbon atoms by a $C_1$-$C_4$ alkyl group. These compounds are capable of improving the antiwear and lubricity properties of low sulfur fuel especially diesel fuels when compared with performance of the same fuel in absence of such compounds.

The use of carboxylic acid ester of an alkanolamine as an additive for improving the lubricity of low sulfur content fuel such as a diesel, bio-diesel or jet fuel has been described by Ethyl Petroleum Additives in European Patent No. EP 0773 279 A1. An interesting disclosure has been made by Placek et al in U.S. Pat. No. 5,630,852 in which lubricity of hydrocarbon fuels have been improved by the addition of a phosphorous ester or esters (phosphates and or phosphites), or a concentrate containing the ester or esters, having a total acid number of at least 1.0 mg KOH/g.

U.S. Pat. No. 6,136,050 presents invention of a diesel fuel oil composition comprising of a base fuel which contains normal paraffin compounds having carbon number of 20 or more at 4.0 wt % or less; has a specific carbon number distribution in the high boiling normal paraffin compounds contain sulfur at 0.05 wt % or less and is incorporated with 0.01 to 0.1 wt % of an friction improver and 0.002 to 0.1 wt % of lubricity improver. The lubricity improver useful for the present invention includes fatty acids and esters.

The WO 0136568, EP 1230328, JP 2003 5149537 describes the inventions related to additive mixture comprising of a) reaction product formed after reaction of a dicarboxylic acid or a derivative thereof with a long chain, aliphatic amine b) natural fatty acid ester, c) the use of said additive mixture for improving the lubricity of fuels and for improving engine resistance to wear, in addition to fuel and lubricant compositions containing said additive mixtures.

Several other patents which describe the use of additive for low sulfur diesel are WO 03/020851, WO 96/23855, WO 98/04656, FR 2772 784 Å etc.

SUMMARY OF INVENTION

The object of the present invention was to develop a lubricity improver composition for use in low sulfur diesel.

A further object of the invention was to propose a lubricity improver, which was effective at lower dosage. Another objective was to develop the lubricity improver composition from easily available, inexpensive raw material.

Another objective of the present invention is to propose a composition, which also provides the rust inhibition characteristics for the diesel fuel.

To achieve the said object, the present invention provides for a lubricity improver composition for use in low sulfur diesel comprising of 0.1-10% by weight of ester derivative derived from cashew nut shell liquid (CNSL esters) of formula

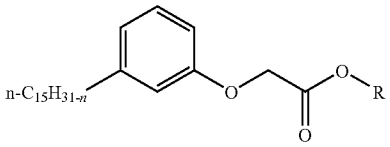

where R = $C_1$-$C_8$
n = 0, 2, 4, 6

Component A) 0.1-10% by weight of ester derivative derived from cashew nut shell liquid of formula

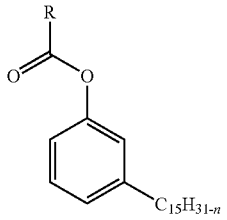

where R = $C_{13}$-$C_{17}$
n = 0, 2, 4, 6

Component B) 50-95% by weight of free fatty acid of the formula R COOH in which R represents an alkyl/alkenyl group with 12 to 24 carbon atoms.

Component C) 1-30% by weight of synthetic esters derived by esterifying tri, tetra, pentahydric alcohols with carboxylic acids such as lauric, palmitic, linoleic, ricinoleic, etc.

The present invention further provides a lubricity improver composition comprising of a liquid diesel fuel having less than 500 ppm by weight sulfur.

60-100 ppm of the above stated composition consisting of free fatty acid, fatty acid ester and CNSL esters.

The low sulfur diesel fuels of this invention include those obtained by methods such as hydrodesufurisation of the diesel fuel fraction at high reaction temperatures, under high hydrogen partial pressure or using a highly active hydrodesulfurisation catalyst.

The low sulfur fuels of the present invention contain less than 400-500 ppm sulfur preferably less than 200 ppm. The ultra low sulfur fuels contain less than 50 ppm sulfur.

DETAILED DESCRIPTION OF THE INVENTION

The present invention is directed to a fuel lubricity additive comprising of esters of cashew nut shell liquid (CNSL), free fatty acids and synthetic esters for improving the lubricity and rust inhibition property of low sulfur diesel. The amount of lubricity increasing additive added depends upon the lubricity of the base fuel.

The provision of such additive is that it does not cause hazing of fuel when fuel comes in contact with water and this additive is effective in relatively low dosage. The lubricity increasing amount is in range of 20-100 ppm. The diesel fuels that are useful in this invention can be of any type of diesel fuel defined by ASTM D-396. The base fuels may comprise of saturated olefinic and aromatic hydrocarbons and these can be derived from straight run streams, thermally or catalytically cracked hydrocarbon feed stocks, hydro cracked petroleum fractions or catalytically reformed hydrocarbons.

The sulfur content of the diesel fuel may be as low as 50 ppm or as high as 0.25% by weight. Any type of diesel fuel with suitable viscosity and boiling range can be used in present invention.

The antiwear and lubricity performance of the fuel compositions are measured using high frequency reciprocating rig test (HFRR). Both friction and contact resistance are monitored throughout the test. The tests are conducted according to standard procedure published in CEC F-06-A-96 in which load of 200 gram is applied at temperature 60° C. for time 75 min. at stroke length of 1 mm at the reciprocating frequency of 50 Hz.

A series of test samples of the present invention were blended in diesel fuel and HFRR studies were carried out. The diesel fuel specification IS: 1460 specifies 0.46 mm (max.) as HFRR value, under which a diesel fuel is considered as having a sufficient lubricity. This limit was set as a lubricity specification when marketing EURODIESEL in 1996, since when practically no pump failure caused by insufficient lubricity of this fuel has occurred in the field, when lubricity is provided naturally by the fuel itself or restored by lubricity improvers. The results of performance of additives of this invention are given in Table 1.

The lubricity improver for the present invention contains three vital components a) Esters of Cashew Nut Shell Liquid b) Synthetic esters c) Free Fatty Acids The chemical compounds suitable for each of these types are explained below Esters of Cashew Nut Shell Liquid The CNSL phenoxy carboxylic acid derivatives of formula

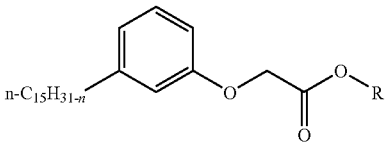

where R = $C_1$-$C_8$
n = 0, 2, 4, 6 are synthesized by first hydrogenating distilled technical cashew nut shell liquid (CNSL) with a catalyst to fully hydrogenate the olefinic chain and reacting said cashew nut shell liquid with halocarboxylic acid to obtain corresponding unpolymerized cashew nut shell liquid alkyl ester, the reaction being carried out at temperature ranging from 20-140° C.

The carboxylic acid required to produce the additives compositions of the present invention contains a halogen substituted hydrocarbon based aliphatic or alicyclic group that is, a group having a halogen atom attached directly to an aliphatic or alicyclic carbon atom, i.e. a carbon atom that is part of an aliphatic or alicyclic based group. The halogen atom in these carboxylic acid reagents is preferably chlorine or bromine.

Among the particularly preferred carboxylic acid reagents used to are alpha halo carboxylic acid reagents having 2 to 20 carbon atoms and being aliphatic or alicyclic based. Examples of carboxylic acid reagents ate chloroacetic acid, ethyl chloroacetate, chloro succinic anhydride, chloro glutaric acid, sodium chloro acetate, methyl chloro stearate.

The esters of cashew nut shell liquid of formula

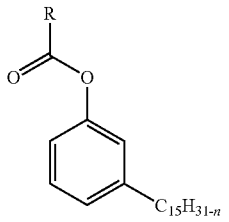

where R = $C_{13}$-$C_{17}$
n = 0, 2, 4, 6 are synthesized by reaction of unhydrogenated or hydrogenated cashew nut shell liquid with fatty acids in the presence of heat or microwave radiations. The fatty acids could be pure fatty acids or a mixture of natural fatty acids from vegetable oils.

Free Fatty Acid

The free fatty acids can be any fatty acid or mixture of fatty acids having alkyl chain of 12-24 carbon atoms. Common examples are lauric, coco, stearic, oleic, linoleic, linolenic, ricinoleic, dehydrated castor oil, tall oil etc.

Modified fatty acids, the isomeric forms such as isostearic acid, alkyl/aryl substituted fatty acid examples being tolyl, phenyl stearic acids i.e. fatty acids with about 12 to about 24 carbon atoms can also be used. Naturally occurring free fatty acid in castor oil, olive oil, rapeseed oil, linseed, coconut, sunflower are also used.

Synthetic Esters

These esters are derived from tri, tetra, penta hydric alcohols typical examples being glycerol, penta erythritol, sorbitol, mannitol etc. These esters are prepared by esterifying alcohols with carboxylic acids. Preferably the carboxylic acids being stearic, oleic, linoleic, erucic, behenic etc. Naturally occurring mixtures of fatty acids e.g. fatty acid from castor oil, olive oil, rapeseed, linseed, coconut oil are used. Specific esters that are effective are sorbitol monooleate, trioleate, monopalmitate, glycerol dioleate, trioleate, monostearate, monocaprate etc.

Lubricity Performance

The wear scar diameter (WSD) is the measure of lubricity performance of the lubricity additive in low sulfur diesel. WSD is measured by high frequency reciprocating rig (HFRR) by ISO-12156 test method in four different fuels, having varying amounts of sulphur (25-200 ppm). A ball is vibrated against a flat metal specimen at 200 g load, 50 Hz frequency, 60° C. temperature, 1 mm amplitude for 75 minutes. The results of lubricity measurement of various additives are reported in Table 1.

TABLE 1

| Lubricity Performance | | | | | | |
|---|---|---|---|---|---|---|
| | | | HFRR (WSD, mm) | | | |
| Example | Composition | Treat Rate (ppm) | Fuel A (25 ppm S) | Fuel B (50 ppm S) | Fuel C (100 ppm S) | Fuel D (150 ppm S) |
| 1 | 100% Component C | 0 | 0.65 | 0.61 | 0.55 | 0.57 |
| | | 50 | 0.52 | 0.51 | 0.52 | 0.53 |
| | | 100 | 0.48 | 0.46 | 0.46 | 0.47 |
| 2 | 100% Component D | 50 | 0.53 | 0.51 | 0.52 | 0.53 |
| | | 100 | 0.47 | 0.47 | 0.46 | 0.48 |
| 3 | 70% Component C + | 50 | 0.53 | 0.54 | 0.52 | 0.53 |
| | 30% Component D | 100 | 0.48 | 0.47 | 0.46 | 0.44 |
| 4 | 70% Component C + | 50 | 0.44 | 0.43 | 0.44 | 0.41 |
| | 20% Component D + 5% Component A + 5% Component B | 100 | 0.39 | 0.40 | 0.37 | 0.36 |
| 5 | 800% Component C + | 50 | 0.51 | 0.51 | 0.52 | 0.51 |
| | 20% Component D | 100 | 0.47 | 0.46 | 0.46 | 0.45 |
| 6 | 70% Component C + | 50 | 0.46 | 0.45 | 0.44 | 0.45 |
| | 25% Component D + 2.5% Component A + 2.5% Component B | 100 | 0.41 | 0.42 | 0.41 | 0.40 |
| 7 | 90% Component C + | 50 | 0.53 | 0.52 | 0.52 | 0.51 |
| | 10% Component D | 100 | 0.46 | 0.47 | 0.46 | 0.45 |
| 8 | 90% Component C + 8% Component D + 1% Component A + | 50 | 0.47 | 0.45 | 0.45 | 0.46 |
| | 1% Component B | 100 | 0.42 | 0.43 | 0.42 | 0.43 |

Compatibility of Lubricity Additives with Water & Diesel

In order to see the compatibility of lubricity additives with water and diesel, Water Reaction Test is performed as per ASTM D-1094 test method. As per this method, 50 ml of the test fuel is shaken with 2 drops of water in 100 ml cylinder for 60 seconds. The cylinder is the placed on flat surface and rated for interface width and separation time. As per results given in Table 2, the water retention characteristics remain unchanged on addition of lubricity additive of invention.

TABLE 2

| Water Reaction Test | | | |
|---|---|---|---|
| | | Results | |
| S.No. | Characteristics Water reaction | Interface width (ml) | Separation time (seconds) |
| 1 | Base Fuel | 1 | 2 |
| 2 | Base Fuel + 100 ppm lubricity improver of Example 4 | 1 | 2 |
| 3. | Base Fuel + 100 ppm lubricity improver of Example 6 | 1 | 2 |

Compatibility with Engine Oil

The compatibility of engine oil with diesel fuel, containing lubricity additive of invention was studied by following tests, involving mixing of lubricity additive with engine oil and storing the resultant mixture at high temperatures.

A) lubricity additive, engine oil, fuel were mixed in ratio of 1:2:20 and then stored at 50° C. for 4 hours and then filtering a 100 ml portion of the mixture through 0.8μ micron filter paper under constant vacuum and noting down the filter time B) mixing the additive and engine oil in ratio of 1:1 v/v and then storing the sample at 90° C. for 72 hours and then dissolving a portion of mixture in fuel in ratio of 1:25 v/v and then filtering as described above Any haze, gel formation or failure to filter is considered fail or filtration time greater than 60 sec is considered to be fail

TABLE 3

| Compatibility with Engine Oil | | | | |
|---|---|---|---|---|
| Fuel | Method | Appearance | Filtration Time (sec.) | Sed-iments (mg) |
| Base fuel | A | Clear, transparent | 30 | 2.0 |
| Base fuel + 50 ppm additive of Example 4 | A | Clear, transparent | 42 | 2.8 |
| Base fuel + 100 ppm additive of Example 4 | A | Clear, transparent | 40 | 2.4 |
| Base fuel + 50 ppm additive of Example 6 | A | Clear, transparent | 38 | 2.5 |
| Base fuel + 100 ppm additive of Example 6 | A | Clear, transparent | 44 | 2.6 |
| Base fuel + 50 ppm additive of Example 4 | B | Clear, transparent | 42 | 2.5 |
| Base fuel + 100 ppm additive of Example 4 | B | Clear, transparent | 36 | 2.6 |
| Base fuel + 50 ppm additive of Example 6 | B | Clear, transparent | 42 | 2.8 |
| Base fuel + 100 ppm additive of Example 6 | B | Clear, transparent | 45 | 2.7 |

Rust Inhibiting Performance

The rust inhibiting performance of additive of the present invention was studied by ASTM D-665A test method. In this method, 300 ml of test fuel and 30 ml of distilled water are stirred at 38° C. in presence of cylindrical steel specimen for 3 hours and rusting on the specimen is rated. As pet results given below, the additive of the present invention controlled rusting noticed in the case of base fuel.

TABLE 4

| Rust Inhibiting Performance | | |
|---|---|---|
| Fuel | % surface covered by rust | Result |
| Base fuel | 100 | Fail |
| Base fuel + 50 ppm additive of Example 4 | 1 | Pass |
| Base fuel + 100 ppm additive of Example 4 | <1 | Pass |
| Base fuel + 50 ppm additive of Example 6 | 1 | Pass |
| Base fuel + 100 ppm additive of Example 6 | <1 | Pass |

The invention claimed is:

1. An additive composition for use as lubricity improver for low sulphur diesel, comprising:

a) 0.1-10% by weight of at least one ester derivative derived from cashew nut shell liquid (CNSL esters) of formula

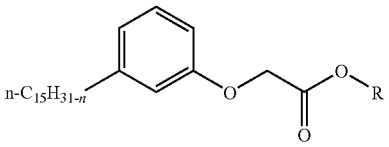

where R = $C_1$-$C_8$, and n = 0, 2, 4, 6;

b) 0.1-10% by weight of at least one ester derivative derived from cashew nut shell liquid of formula

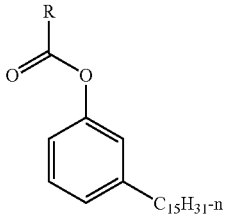

where R = $C_{13}$-$C_{17}$, and n = 0, 2, 4, 6;

c) 50-95% by weight of free fatty acid of the formula RCOOH in which R represents an alkyl/alkenyl group with 12 to 24 carbon atoms; and d) 1-30% by weight of synthetic esters derived by esterifying tri, tetra, pentahydric alcohols with carboxylic acids selected from lauric, palmitic, linoleic, ricinoleic.

2. An additive composition as claimed in claim 1 comprising:

a) 0.1-20% by weight of esters of cashew nut shell liquid;

b) 60-80% by weight of free fatty acids;

c) 5-20% by weight of synthetic esters.

3. An additive composition as claimed in claim 2 comprising a) 10% by weight of esters of cashew nut shell liquid;

b) 70% by weight of free fatty acids;

c) 20% by weight of synthetic esters.

4. An additive composition as claimed in claim 1, wherein component (a) is a mixture of compounds having R═C1 to C8 and n=0, 2, 4 & 6.

5. An additive composition as claimed in claim 1, wherein component (b) is a mixture of compounds having R═C13 to C17 and n=0, 2, 4 & 6.

6. An additive composition as claimed in claim 1, wherein said esters of cashew nut shell liquid include esters of technical CNSL or hydrogenated CNSL or mixtures thereof.

7. An additive composition as claimed in claim 1 wherein said free fatty acids include a mixture of fatty acids having alkyl chain of 12-24 carbon atoms.

8. An additive composition as claimed in claim 7 wherein said free fatty acids include fatty acid selected from lauric acid, coco acid, stearic acid, oleic acid, linoleic acid, linolenic acid, and ricinoleic acid.

9. An additive composition as claimed in claim 7 wherein said free fatty acids include isomeric forms.

10. An additive composition as claimed in claim 9 wherein said free fatty acids include isomeric forms selected from isostearic acid, and alkyl/aryl substituted fatty acid.

11. An additive composition as claimed in claim 1 wherein said synthetic esters include esters of glycerol, pentaerythritol, or mixtures thereof.

12. An additive composition as claimed in claim 1 wherein said synthetic esters include esters of palmitic, stearic, oleic, linoleic acids or mixtures thereof.

13. A diesel fuel composition comprising 10-500 ppm by weight of additive composition as claimed in claim 1.

14. A diesel fuel composition comprising 100 ppm by weight of additive composition as claimed in claim 1.

* * * * *